US005222929A

United States Patent [19]

Duda

[11] Patent Number: 5,222,929

[45] Date of Patent: Jun. 29, 1993

[54] WALKING EXERCISE APPARATUS

[76] Inventor: Richard Duda, 297 Concord Rd., Bedford, Mass. 01730

[21] Appl. No.: 826,442

[22] Filed: Jan. 27, 1992

[51] Int. Cl.[5] ..... A63B 21/22

[52] U.S. Cl. ..... 482/110; 482/108; 482/1

[58] Field of Search ..... 482/93, 106, 107, 108, 482/109, 22, 50, 74, 92, 148, 110, 44; 496/247, 485, 117; 273/58 C, 58 G, 64, 58 K

[56] References Cited

U.S. PATENT DOCUMENTS

| | | | |
|---|---|---|---|
| 688,599 | 12/1901 | Creelman | 482/109 |
| 1,316,683 | 9/1919 | Calvert | 482/108 |
| 1,333,005 | 3/1920 | Warner | 482/110 |
| 1,658,108 | 2/1928 | Vaughn | 482/109 |

OTHER PUBLICATIONS

Pendulum Exerciser, Ormandy, Bowen and Company JB & JS vol. A6-A#3 Apr. 1964.

*Primary Examiner*—Richard J. Apley
*Assistant Examiner*—Jerome Donnelly
*Attorney, Agent, or Firm*—Leon Gilden

[57] ABSTRACT

An exercise apparatus is arranged to include a spherical body spaced from a handle to permit swinging of the spherical body to promote extension of an individual's arms during an exercise procedure such as walking. A modification of the invention includes the spherical body formed with an upper and lower cylindrical wall defining a planar annular plate to accommodate a mounting plate that in turn is arranged to receive various weighted cups to permit modification and tailoring of the weight of the spherical body portion. Indicator lights are arranged in a modifier aspect of the invention to permit utilization of the organization during evening hours to alert passing individuals as to the position of a walking individual.

7 Claims, 4 Drawing Sheets

WALKING EXERCISE APPARATUS

FIELD OF THE INVENTION

1. Field of the Invention

The field of invention relates to exercise apparatus, and more particularly pertains to a new and improved walking exercise apparatus wherein the same effects extension of an individual's arms in a walking procedure.

2. Description of the Prior Art

Various exercise apparatus has been utilized throughout the prior art relative to exercise. Such apparatus is exemplified in the U.S. Pat. No. 4,869,495 to Greenberg wherein a spherical weight is mounted relative to a rod terminating in an upper loop portion for securement about an individual's neck.

U.S. Pat. No. 4,830,361 to Hoffman sets forth an arm exercise apparatus.

U.S. Pat. No. 4,913,421 to Bachman sets forth a hand-held exercise apparatus permitting affixing of various exercise weights thereto.

A such, it may be appreciated that there continues to be a need for a new and improved walking exercise apparatus as set forth by the instant invention which addresses both the problems of ease of use as well as effectiveness in construction permitting the enhanced extension and full use of an individual's arms in association with an exercise procedure, such as walking, and in this respect, the present invention substantially fulfills this need.

SUMMARY OF THE INVENTION

In view of the foregoing disadvantages inherent in the known types of exercise apparatus now present in the prior art, the present invention provides a walking exercise apparatus wherein an individual utilizes a sphere secured in a remote orientation by a handle to permit extension of an individual's arms during an exercise procedure. As such, the general purpose of the present invention, which will be described subsequently in greater detail, is to provide a new and improved walking exercise apparatus which has all the advantages of the prior art exercise apparatus and none of the disadvantages.

To attain this, the present invention provides an exercise apparatus arranged to include a spherical body spaced from a handle to permit swinging of the spherical body to promote extension of an individual's arms during an exercise procedure such as walking. A modification of the invention includes the spherical body formed with an upper and lower cylindrical wall defining a planar annular plate to accommodate a mounting plate that in turn is arranged to receive various weighted cups to permit modification and tailoring of the weight of the spherical body portion. Indicator lights are arranged in a modified aspect of the invention to permit utilization of the organization during evening hours to alert passing individuals as to the position of a walking individual.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved walking exercise apparatus which has all the advantages of the prior art exercise apparatus and none of the disadvantages.

It is another object of the present invention to provide a new and improved walking exercise apparatus which may be easily and efficiently manufactured and marketed.

It is a further object of the present invention to provide a new and improved walking exercise apparatus which is of a durable and reliable construction.

An even further object of the present invention is to provide a new and improved walking exercise apparatus which is susceptible of a low cost of manufacture with regard to both materials and labor, and which accordingly is then susceptible of low prices of sale to the consuming public, thereby making such walking exercise apparatus economically available to the buying public.

Still yet another object of the present invention is to provide a new and improved walking exercise apparatus which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its used, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
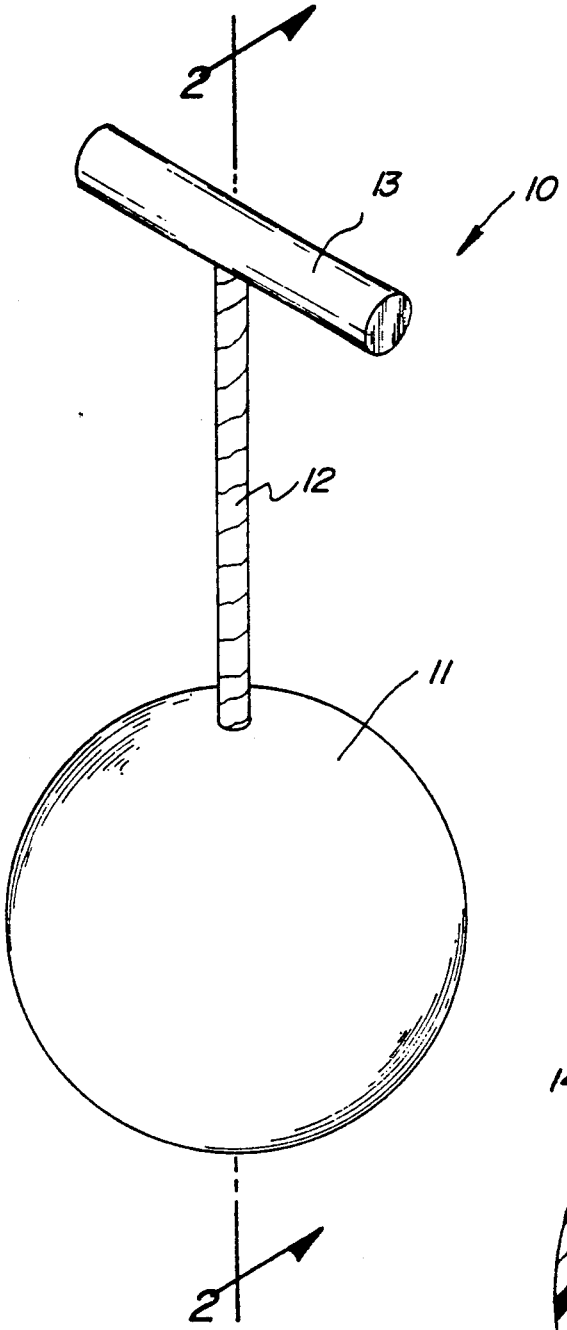
FIG. 1 is an isometric illustration of the instant invention.

With reference now to the drawings, and in particular to FIGS. 1 to 7 thereof, a new and improved walking exercise apparatus embodying the principles and concepts of the present invention and generally designated by the reference numerals 10, 10*a*, and 10*b* will be described.

More specifically, the walking exercise apparatus 10 of the instant invention is arranged for use with an apparatus 10 for securement by each individual's hand during a walking procedure to permit full extension during walking. For purposes of example only, only one of such members will be set forth as it is understood that such apparatus is to be utilized in pairs.

Figure 2:
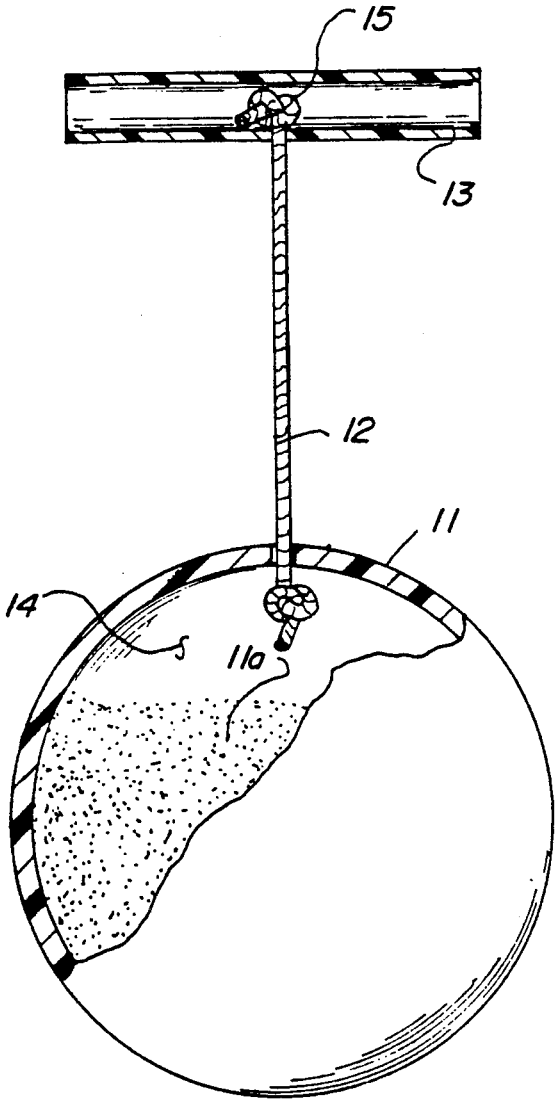
FIG. 2 is an orthographic view, taken along the lines 2—2 of FIG. 1 in the direction indicated by the arrows.

The apparatus 10 includes a spherical body 11 formed, as illustrated in FIGS. 1 and 2, with a flexible tether line 12 extending from the spherical body 11 upwardly thereof terminating in its mounting to a tubular handle member 13 that is formed with a handle cavity 16 coaxially directed through the handle member 13. A knot 15 is contained within the handle cavity 16 permitting variation of length of the tether line in use. Typically, a granular material 11*a* is contained within the cavity 14.

Figure 3:
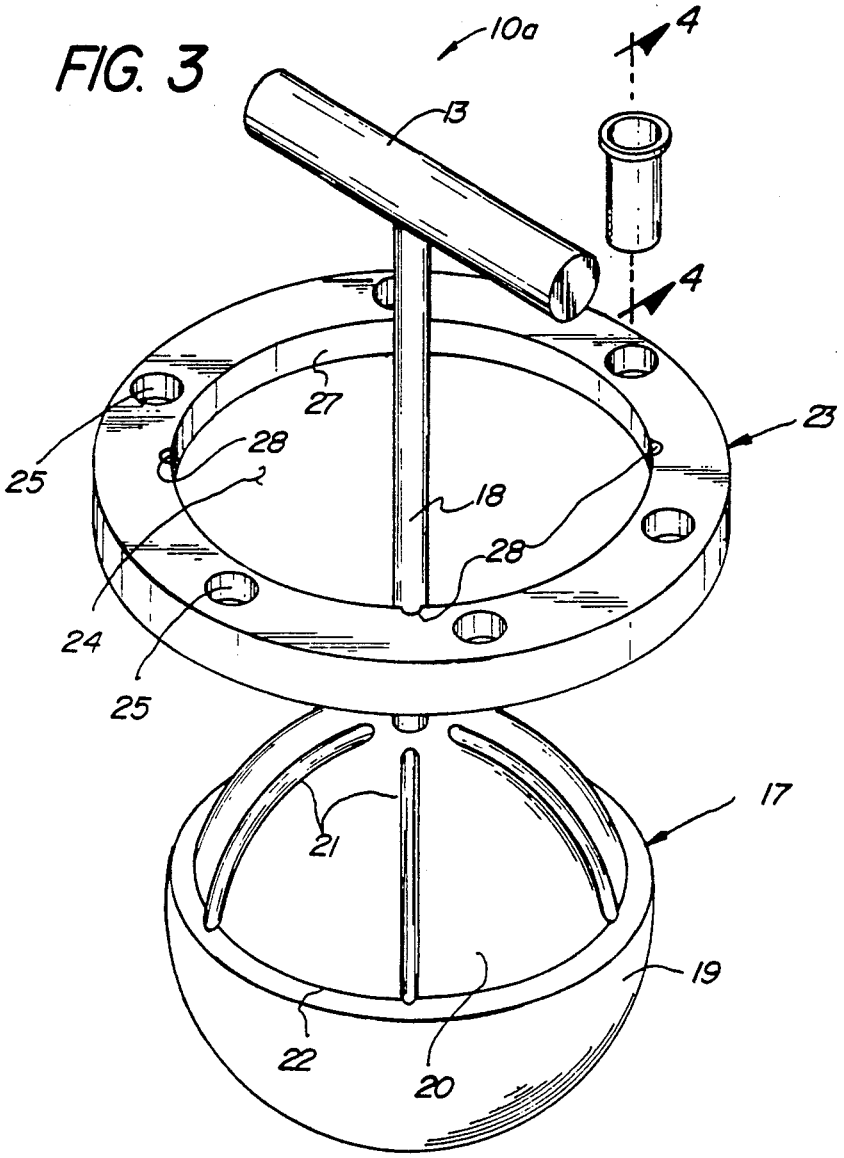
FIG. 3 is an isometric illustration of a modification of the invention.
Figure 4:
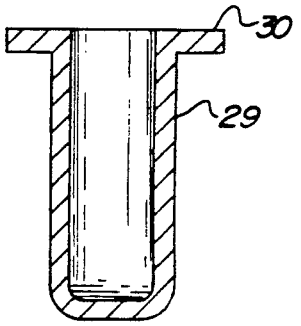
FIG. 4 is an orthographic view, taken along the lines 4—4 of FIG. 3 in the direction indicated by the arrows.

The apparatus 10*a*, as illustrated in the FIGS. 3 and 4, is arranged to configure the spherical body 17, with a lower semi-spherical wall 19 secured to an upper semi-spherical wall 20, with a rigid rod 18 extending medially of the upper semi-spherical wall 20 terminating in the handle 13. A planar annular flange 22 is arranged diametrically relative to the spherical body 17 at an equatorial intersection of the upper and lower spherical walls 20 and 19 to receive a torroidal or cylindrical mounting plate 23 therein. The mounting plate 23 includes a plate central bore 24 defined by a bore diameter, wherein the lower semi-spherical wall 19 is defined by a first diameter, the upper semi-spherical wall 20 defined by a second diameter, wherein the second diameter is greater than the first diameter, and wherein the central bore 24 is defined by a bore diameter substantially equal to the second diameter to position the mounting plate 23 on the annular flange 22, in a manner as illustrated in the FIG. 5. A plurality of support bores 25 are directed through the mounting plate 23 at predetermined spatial intervals, wherein each of the support bores axes are arranged parallel to an axis of the central bore 24 permitting each of the support bores 25 to receive a weighted cup 29 therethrough. The weighted cup 29 of a plurality of such cups to be optionally utilized is formed with a cup flange 30 extending laterally beyond the weighted cup, wherein a cup flange diameter is greater than the diameter defined by each of the support bores. Further, the central bore 24 includes a central bore interior cylindrical wall 27 formed with parallel grooves 28 spaced apart to each receive the longitudinal rib 21 of a plurality of such longitudinal ribs that are integrally formed to the upper spherical wall 20 orthogonally oriented relative to the annular flange 22 to permit registration and alignment of the mounting plate 23 to the annular flange, in a manner as illustrated in FIG. 5.

Figure 5:
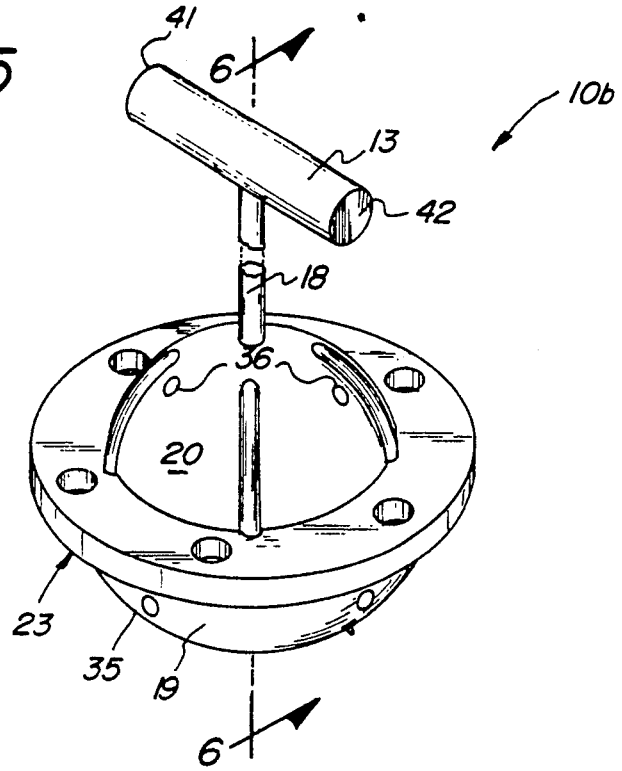
FIG. 5 is an isometric illustration of a further modification of the invention.
Figure 6:
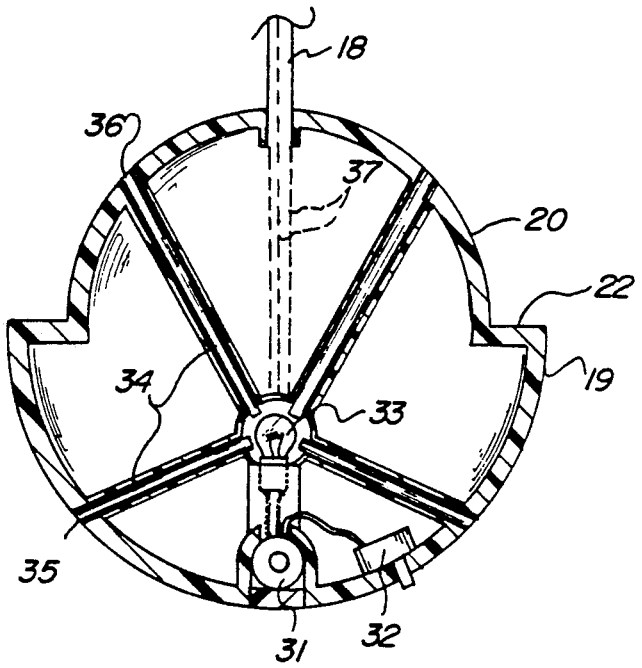
FIG. 6 is an orthographic view, taken along the lines 6—6 of FIG. 5 in the direction indicated by the arrows.
Figure 7:
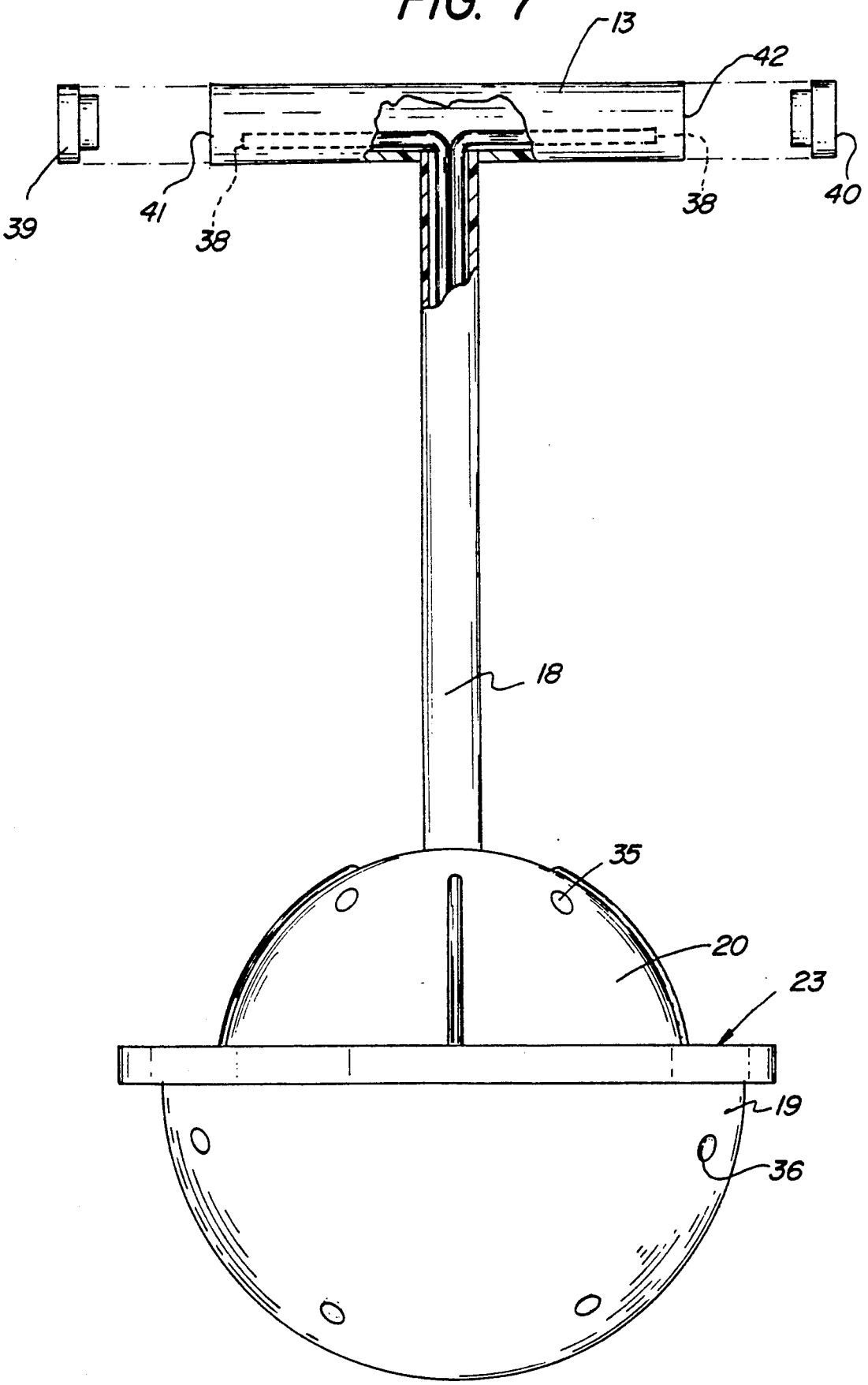
FIG. 7 is an orthographic side view, taken in elevation, of the further modification of the invention as set forth in FIG. 6.

The further defined apparatus 10*b*, such as illustrated in the FIGS. 5–7, includes a battery 31 positioned through the lower semi-spherical wall 19. An on/off switch 32 is projected through the lower semi-spherical wall 19 in electrical communication between the battery 31 and illumination bulb 33 mounted within the spherical body 17. Further, a plurality of first fiber optic cables 34 are radially directed from the illumination member 33 and project through the upper and lower semi-spherical walls 20 and 19 in respective first and second free ends 35 and 36 aligned with respective upper and lower walls 20 and 19. A plurality of second fiber optic cables 37 are directed from the illumination bulb 33 through the handle 18 and terminate in second free ends 38, where on of such free ends 38 is positioned adjacent each respective first and second handle end 41 and 42 that is in turn arranged to receive a respective first and second translucent cap 39 and 40. The translucent caps 39 and 40 may be of multi-coloration, such as red, green, and the like, for indication of an individual's position during a walking procedure such as typically utilized n evening hours. The fiber optic free ends 35 and 36 are arranged to further enhance visibility of an individual utilizing the organization during evening hours.

The manner of operation as set forth should be understandable from the above disclosure, and accordingly no further discussion relative to the usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A walking exercise apparatus, comprising, a spherical body, the spherical body including a central cavity, and a support member extending from the spherical body radially directed into the spherical body secured thereto, and the support member including a handle mounted at an upper distal end of the support member spaced from the spherical body, the handle formed as an elongate tubular member, with the support member medially intersecting the handle, and the spherical body includes a lower semi-spherical wall and an upper semi-spherical wall, the lower semi-spherical wall defined by a first diameter, the upper semi-spherical wall defined by a second diameter less than the first diameter, and a planar annular flange is arranged in surrounding relationship relative to an equatorial intersection of the lower semi-spherical wall with the upper semi-spherical wall, and the support member orthogonally oriented relative to the planar annular flange, and the support member is a rigid tubular rod, and a torroidal mounting plate, the torroidal mounting plate including a central bore, the central bore substantially equal to the second diameter to permit mounting of the mounting plate upon the planar annular flange.

2. An apparatus as set forth in claim 1 wherein the mounting plate includes a plurality of support bores directed through the annular flange, the support bores each include a support bore axis, the central bore is defined by the central bore axis, wherein each support bore axis is parallel to the central bore axis.

3. An apparatus as set forth in claim 2 wherein the upper semi-spherical wall includes a plurality of longitudinal ribs extending from the tubular rod to the annular flange, wherein each of the ribs orthogonally intersects the annular flange, and the mounting plate includes a central bore cylindrical wall, the central bore cylindrical wall includes a series of parallel grooves directed therethrough, wherein each groove is arranged to receive a single longitudinal rib of said longitudinal ribs.

4. An apparatus as set forth in claim 3 including at least one weight cup, said at least one weight cup is of a cylindrical configuration arranged for reception within at least one of said support bores, and said at least one weight cup includes a cup flange laterally projecting exteriorly of each weight cup at an upper distal end of said at least one weight cup to position the cup flange to a top surface of the mounting plate when the at least one weight cup is directed through the at least one of said support bores.

5. An apparatus as set forth in claim 4 wherein the spherical body cavity includes a battery contained therewithin, and an on/off switch directed through the spherical body, and an illumination bulb positioned within the spherical body cavity, and a plurality of first fiber optic cables, wherein each of the first fiber optic cables includes a first end positioned adjacent the illumination bulb, and each of the first fiber optic cables includes a second end directed through the spherical body to direct illumination to the first fiber optic cables exteriorly of the spherical body.

6. An apparatus as set forth in claim 5 including a plurality of second fiber optic cables, the second fiber optic cables are directed from the illumination bulb through the tubular rod, and the handle includes a handle first end and a handle second end, and at least one of said second fiber optic cables is directed to the handle first end and at least one of said second fiber optic cables is directed through the handle second end, and a first translucent cap received within the handle first end and the second translucent cap received within the handle second end.

7. An apparatus as set forth in claim 6 wherein the first translucent cap and the second translucent cap are of contrasting colorations.

* * * * *